United States Patent [19]

Weitz

[11] 4,363,837

[45] Dec. 14, 1982

[54] ARTIFICIAL FLOWER

[76] Inventor: Henry Weitz, Prosperity House, 11th Floor, 8A-10 Granville Rd., Kowloon, Hong Kong

[21] Appl. No.: 314,234

[22] Filed: Oct. 23, 1981

[51] Int. Cl.[3] ..... A41G 1/00

[52] U.S. Cl. ..... 428/26; 403/373

[58] Field of Search ..... 428/17–24, 428/25, 26; 156/61; 403/373

[56] References Cited

U.S. PATENT DOCUMENTS

| | | | |
|---|---|---|---|
| 1,870,208 | 8/1932 | Crosser | 428/17 X |
| 1,879,677 | 9/1932 | Gockel | 428/26 |
| 2,879,617 | 3/1959 | Popeil | 428/24 X |
| 4,324,821 | 4/1982 | Heineman | 428/24 |

*Primary Examiner*—Henry F. Epstein

*Attorney, Agent, or Firm*—Alvin Sinderbrand

[57] ABSTRACT

An artificial flower is formed of a plurality of individual petal-like members of fabric each including a medial stiffening wire secured thereto for simulating a vein and having an end portion projecting from the respective petal-like member, an assembling element having a peripheral surface with substantially parallel grooves extending therealong for receiving the projecting end portions of the stiffening wires, and a clamping ring encircling the peripheral surface of the assembling element for securing the projecting end portions of the stiffening wires in the respective grooves. The assembling element has an axial bore opening at one end to receive a central plug of stamen-and pistil-simulating member and at the other end to receive an end portion of an elongated, stalk-like element for mounting the petal-like members and the stamen-and pistil-simulating member on the stem or stalk-like element.

9 Claims, 7 Drawing Figures

FIG. 1
PRIOR ART
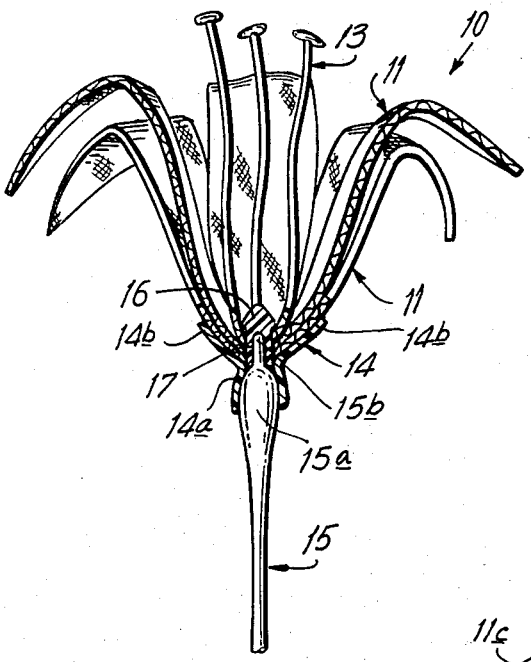
FIG. 2
PRIOR ART
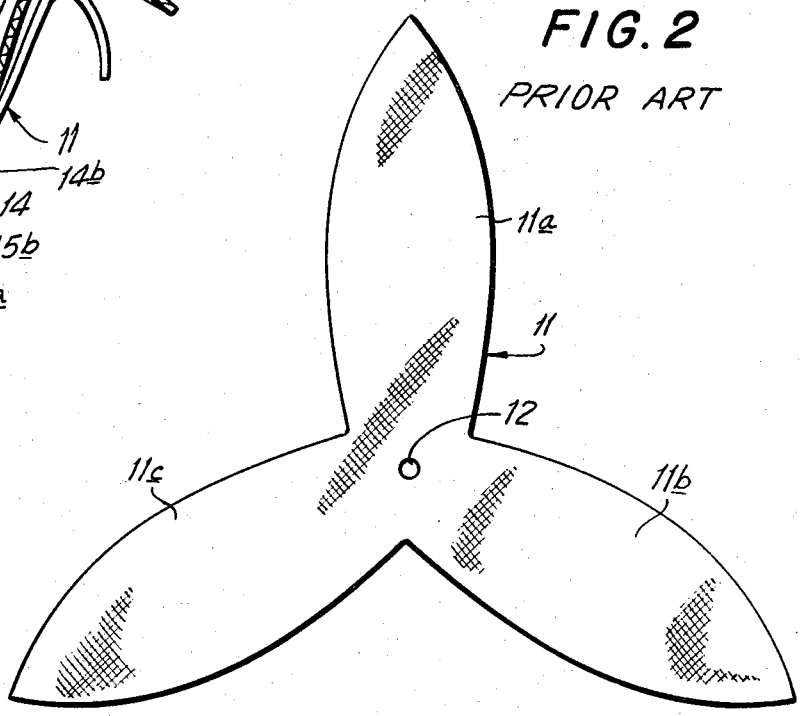
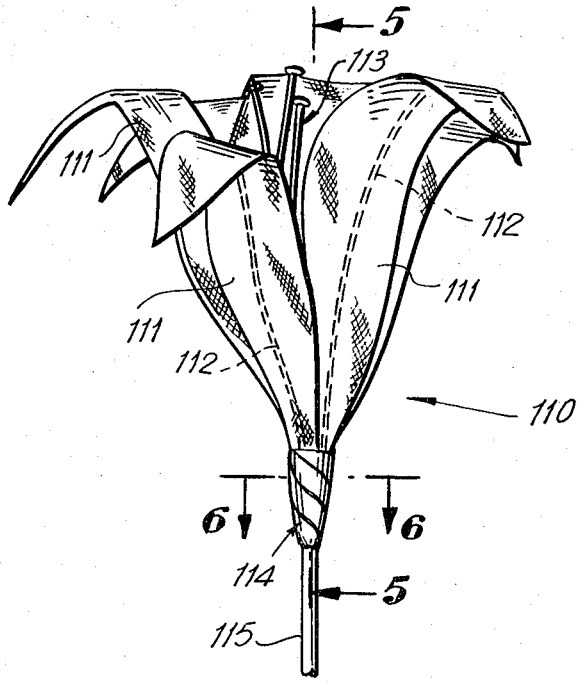
FIG. 3

ARTIFICIAL FLOWER

BACKGROUND OF THE INVENTION

1. Field of the Invention

This invention relates generally to artificial flowers and, more particularly, is directed to improvements in artificial flowers of the type having at least the petals thereof formed of fabric so as to closely simulate the appearance of natural flowers.

2. Description of the Prior Art

Many types of artificial flowers have been produced. Recently, the most life-like or natural looking of these artificial flowers have been formed with petals of a light-bodied synthetic textile fabric, for example, of polyester, which are assembled together with other elements, for example, representing the stamen pistil and stalk or stem, to form the complete article. In the case of artificial flowers of substantial size, the petals of limp or light-bodied fabric have been formed individually and each provided with a medial stiffening wire secured thereto for simulating a vein and having a projecting end portion. When assembling an artificial flower comprised of individually formed fabric petals, as aforesaid, the projecting end portions of the stiffening wires, the stamen-and pistil-simulating elements and a stem or stalk-like element are manually bunched together and, while being thus relatively positioned, are wrapped about with wire. The foregoing procedure is undesirable in that it is laborious, and thus relatively costly, and further in that it fails to ensure that the several elements making up the artificial flower will be relatively positioned in a consistent manner to provide the desired life-like or natural appearance.

In order to minimize the labor required for the assembly of artificial flowers having fabric petals, it has been proposed to form a plurality of the petals as a unitary fabric member having a hole at the center through which there is extended, from one side, an apertured boss, for example, formed at the base of a molded plastic stamin-and pistil-simulating member, while a calyx-like plastic member is mounted on the apertured boss from the other side of the unitary fabric member to secure the latter in place and to complete the artificial flower which is mounted on a stalk or stem having an end portion frictionally plugged into the apertured boss. Although the foregoing arrangement desirably facilitates the assembling of artificial flowers for reducing the cost thereof, such arrangement is suitably only for the production of relatively small artificial flowers in which the absence of stiffening wires for the petals will not detract from the natural appearance thereof, particularly when the petals are formed of a limp or light-bodied fabric which is otherwise desired for a truly life-like appearance.

OBJECTS AND SUMMARY OF THE INVENTION

Accordingly, it is an object of this invention to provide artificial flowers of natural or life-like appearance which can be easily assembled so as to simulate even large blooms.

More specifically, it is an object of this invention to facilitate the assembling together of artificial flowers each formed of a plurality of individual petal-like fabric members having medial stiffening wires so that a limp or light-bodied fabric can be used for each petal-like member while ensuring that a desired shape of the latter can be selectively imparted thereto and retained.

In accordance with an aspect of this invention, an artificial flower is formed of a plurality of individual petal-like members of fabric each including a medial stiffening wire secured thereto for simulating a vein and having an end portion projecting from the respective petal-like member, an assembling element having a peripheral surface with substantially parallel grooves extending therealong for receiving and positioning the projecting end portions for the stiffening wires, and means, for example, in the form of a clamping ring encircling the peripheral surface of the assembling element which preferably tapers, for securing the projecting end portions of the stiffening wires in the respective grooves.

In a preferred embodiment of the invention, the assembling element has an axial bore opening at one end to receive a central plug of a stamen-and pistil-simulating member, while the other end of the axial bore opens to receive an end portion of an elongated stem or stalk-like element for mounting the petal-like members and the stamen-and pistil-simulating member on the stem or stalk-like element.

The above, and other objects, features and advantages of the invention, will be apparent in the following detailed description of illustrative embodiments thereof which is to be read in connection with the accompanying drawings.

BRIEF DESCRIPTION OF THE DRAWINGS

FIG. 1 is a vertical sectional view of an artificial flower having fabric petals in an arrangement according to the prior art for facilitating the assembly of the artificial flower;

FIG. 2 is a plan view of a unitary fabric member constituting a plurality of the petals of the artificial flower illustrated on FIG. 1;

FIG. 3 is a side elevational view of an artificial flower according to an embodiment of the present invention;

DETAILED DESCRIPTION OF THE PREFERRED EMBODIMENTS

Figure 4:
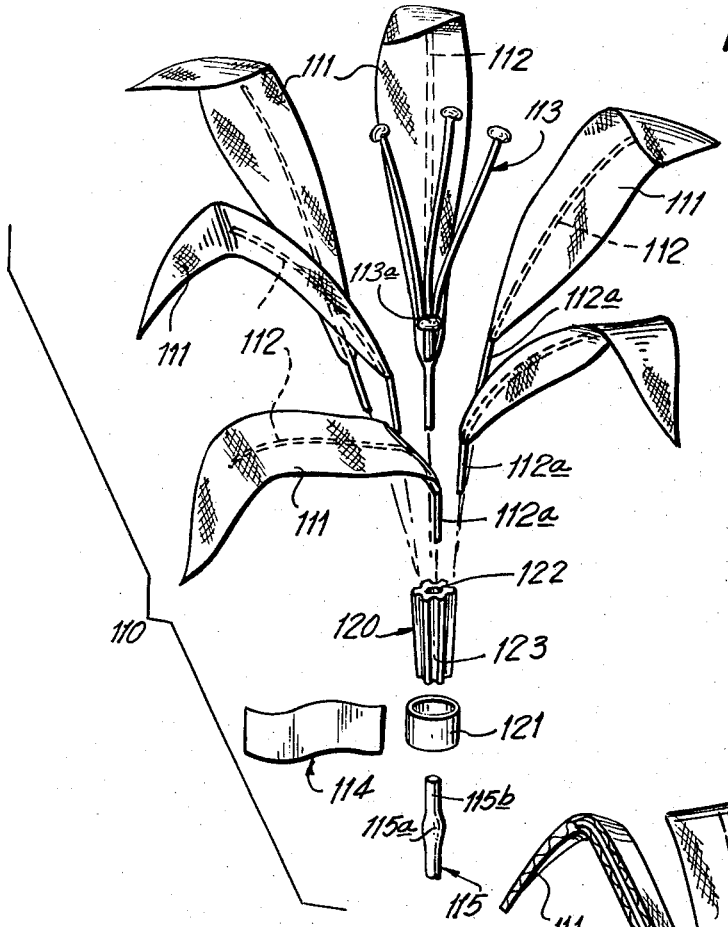
FIG. 4 is an exploded perspective view showing the various elements included in the artificial flower of FIG. 3.

In order to promote appreciation of the advantages of the present invention, reference will first be made to FIG. 1 of the drawings in which an artificial flower 10 according to one proposal of the prior art for reducing the labor involved in assembling the artificial flower is shown to comprise one or more unitary fabric members 11 each stamped or cut to define a plurality of radiating petal-like portions, as at 11*a*, 11*b* and 11*c* on FIG. 2, and each formed with a central hole 12. The illustrated artificial flower 10 according to the prior art is further shown to comprise a stamen-and pistil-simulating member 13, a calyx-like member 14 and a stem or stalk-like element 15. The stamen-and pistil-simulating member 13 may be suitably molded of a plastic or synthetic resin so as to have a base 16 with an apertured boss 17 extending therefrom which is dimensioned to be received in the central hole 12 of each of the fabric members 11. The calyx-like member 14 is molded of a suitably pliant plastic or synthetic resin so as to have a generally tubular lower portion 14*a* with sepal-like projections 14*b* extending from the top thereof, for example, as shown on FIG. 7. The stem or stalk-like element is shown to have a node or thickened portion 15*a* at its upper end from which a plug 15*b* extends.

In assembling the artificial flower of the prior art, and assuming that a plurality of the unitary fabric members 11 are employed for simulating the flower petals as on FIG. 1, such fabric members 11 are superposed with their central holes 12 in registration, and with the petal-like portions 11*a*, 11*b* and 11*c* of each fabric member 11 staggered relative to the corresponding petal-like portions of the other fabric members 11. Then, the base 16 of the stamen-and pistil-simulating member 13 is pressed, from above, against the center of the superposed fabric members 11 to extend its apertured boss 17 through the registered holes 12, and the calyx-like member 14 is applied against the superposed fabric members 11, from below, to frictionally engage the outer peripheral surface of apertured boss 17 in tubular portion 14*a* immediately below sepal-like projections 14*b*. Finally, the plug or extension 15*b* of stalk-like element 15 is frictionally engaged, from below, in the aperture of boss 17, with the node 15*a* extending into and preferably dilating the lower end of tubular portion 14*a* of the calyx-like member 14.

Although the above described artificial flower 10 according to the prior art can be easily and quickly assembled with a minimum expenditure of labor, there are a number of disadvantages inherent therein. More particularly, since a plurality of petals are defined by portions of each unitary fabric member 11, each of the petals cannot be conveniently provided with a medial stiffening wire. Thus, if the fabric members 11 are formed of a thin and limp or light-bodied fabric, for example, of polyester fibers, so as to provide a natural appearance and feel thereto, it is not possible to reliably impart desired shapes and formations to the petals for simulating various types of flowers, particularly when anything other than relatively small artificial flowers are being formed.

Figure 5:
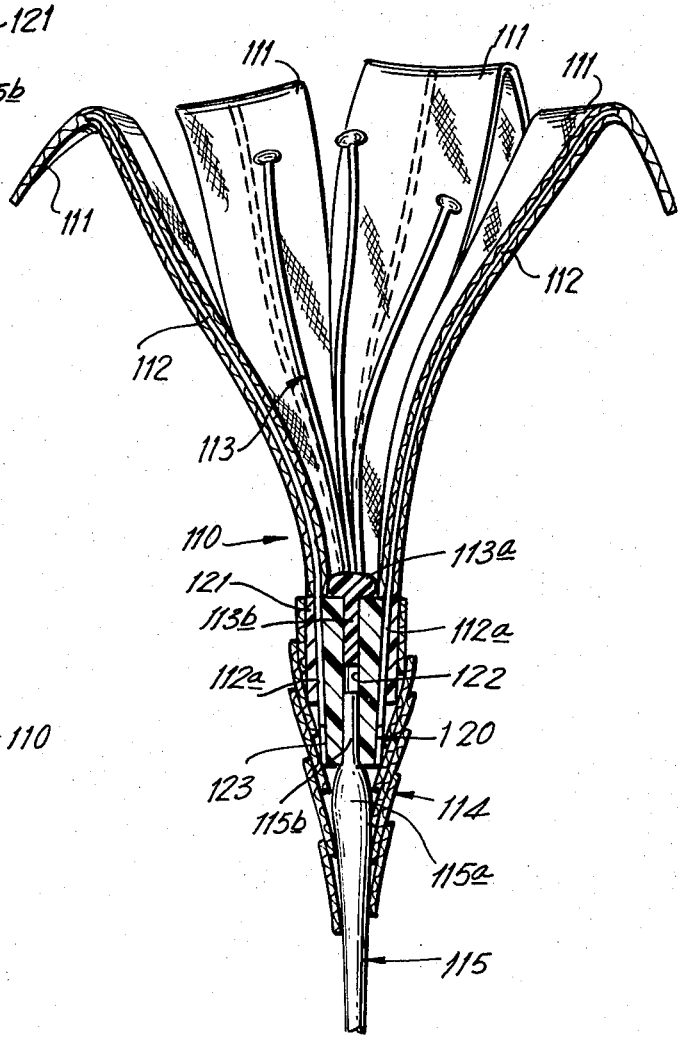
FIG. 5 is an enlarged sectional view taken along the line 5—5 on FIG. 3.
Figure 6:
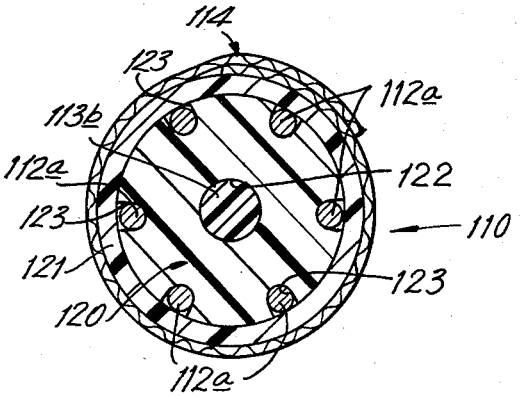
FIG. 6 is a still further enlarged sectional view taken along the line 6—6 on FIG. 3.

Referring now to FIGS. 3, 4 and 5, it will be seen that, in order to avoid the above mentioned disadvantages inherent in the described artificial flower of the prior art, an artificial flower 110 according to the present invention has a plurality of petal-like members 111 formed individually of a suitable fabric, for example, of polyester, and each including a medial stiffening wire 112 adhesively or otherwise secured thereto for simulating a vein and having an end portion 112*a* projecting from the respective petal-like member 111. By reason of the stiffening wire 112, which is formed of a suitably malleable metal, each of the petals 111 can be shaped and reshaped, as desired, so as to most closely approximate the natural appearance of the petals of a flower being simulated, and the individual petals will retain the desired shapes until the same are intentionally altered.

For facilitating the assembly of the individual petal-like members 111 with each other and with other elements of the artificial flower 110 according to this invention, for example, with a stamen-and pistil-simulating member 113 and an elongated stalk-like element 115, there is provided a generally tubular assembling element 120 and a clamping element 121 for cooperative association therewith. The generally tubular assembling element 120 has an axial bore 122 opening at its opposite ends and an outer or peripheral surface which preferably tapers toward one end and which is formed with substantially parallel grooves 123 extending therealong for receiving the projecting end portions 112*a* of stiffening wires 111. Clamping element 121 is shown to be preferably in the form of a ring which is diametrically dimensioned to fit loosely over the tapered peripheral surface of assembling element 120 at the small diameter end thereof, and to come into secure clamping engagement with the peripheral surface of element 120 in response to axial sliding displacement of clamping ring 121 toward the relatively large diameter end of element 120. Preferably, assembling element 120 is molded or otherwise suitably formed of a relatively hard plastic or synthetic resin, such as, polyvinyl chloride, while clamping ring 121 is formed of an elastomeric plastic or synthetic resin, such as, polyethylene, so as to exert an elastic clamping action on assembling element 120 when securely engaged with the peripheral surface of the latter.

As shown particularly on FIGS. 4 and 5, the stamen-and pistil-simulating member 113 of artificial flower 110 desirably has a base 113*a* with a depending plug or extension 113*b* dimensioned to be frictionally engaged in axial bore 122 of assembling element 120. Stem or stalk-like element 115 may be similar to that employed with artificial flower 10 of the prior art, and thus is shown to be provided with a node or enlargement 115*a* at its upper portion from which there is directed a plug or extension 115*b* also adapted to be frictionally engaged in bore 122.

In assembling the artificial flower 110 according to the present invention, the several petal-like fabric members 111 are manually positioned with the projecting end portions 112*a* of their stiffening wires 112 extending axially into respective grooves 123 at the relatively larger-diameter end portion of the peripheral surface of element 120. With stiffening wire end portion 112*a* thus disposed in grooves 123 of element 120, clamping ring 121 is slideably extended onto the peripheral surface of assembling element 120 at the relatively small diameter end thereof. As clamping ring 121 is axially displaced along assembling element 120 toward the relatively large diameter end thereof, clamping ring 121 comes into elastic clamping engagement with stiffening wire end portions 112*a* for securing the latter in respective grooves 123. With the stiffening wire end portions 112*a* of the several petal-like fabric members 111 thus secured to assembling element 120, the petal-like members 111 radiate from the relatively large diameter end of element 120 and can be individually suitably shaped for simulating the appearance of the petals of a desired flower. The stamen-and pistil-simulating member 113 then has its plug 113*b* extended into, and frictionally held in the end portion of bore 122 which opens at the relatively large diameter end of element 120 so that stamen-and pistil-simulating member 113 will be desirably positioned amid the petal-like members 111. The stem or stalk-like element 115 then has its extension 115*b* inserted, and frictionally held in the end portion of bore 122 opening at the relatively small diameter end of assembling element 120. The assembling of flower 110 may be completed by wrapping a suitable pressure sensitive tape 114 about assembling element 120, clamping ring 121 and the adjacent node 115*a* of stalk-like element 115 for providing a finished appearance to the artificial flower.

Figure 7:
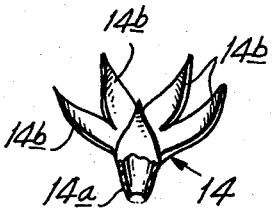
FIG. 7 is a perspective view of a calyx-like element which may be employed in the artificial flower of the prior art and also in a modification of the artificial flower according to this invention shown on FIGS. 3–6.

Alternatively, in place of tape 114 wrapped about assembling element 120 and clamping ring 121, the artificial flower 110 according to this invention may be provided with the calyx-like member 14 of FIG. 7, in which case the generally tubular portion 14*a* of member 14 will be dimensioned to extend closely about assembling element 120 and clamping ring 121 from node 115*a* of the stalk like element to the end of element 120 from which petal-like members 111 extend, whereby the sepal-like projections 14*b* will lie close against the lower end portions of petal-like members 111.

It will be appreciated that the described artificial flowers according to this invention can be easily assembled with a minimum expenditure of labor, while permitting the use of individual petal-like members of light-bodied fabric provided with stiffening wires so that natural feeling petals, of even relatively large artificial flowers embodying the invention, can be given life-like shapes which are reliably retained.

Although illustrative embodiments of the invention have been described in detail herein with reference to the accompanying drawings, it is to be understood that the invention is not limited to those precise embodiments and that various changes and modifications may be effected therein by one skilled in the art without departing from the scope or spirit of the invention, as defined in the appended claims.

What is claimed is:

1. An artificial flower comprising a plurality of individual petal-like members of fabric each including a medial stiffening wire secured thereto for simulating a vein and having an end portion projecting from the respective petal-like member, an assembling element having a peripheral surface with substantially parallel grooves extending therealong and opening axially at least at one end and also radially outward for receiving the projecting end portions of the stiffening wires of said petal-like members, and means extending about said assembling element for securing said projecting end portions of the stiffening wires in the respective grooves.

2. An artificial flower according to claim 1; wherein said means for securing said projecting end portions of the stiffening wires includes a clamping ring encircling said peripheral surface of the assembling element with said projecting end portions of the stiffening wires in said respective grooves.

3. An artificial flower according to claim 2; wherein said peripheral surface of the assembling element tapers toward one end of the latter, and said clamping ring is dimensioned to fit loosely on said assembling element at said one end and to securely clamp against said peripheral surface in response to movement of said clamping ring axially along said assembling element toward the other end of the latter.

4. An artificial flower according to claim 3; wherein said assembling element is formed of a relatively hard synthetic resin material and said clamping ring is formed of a relatively elastomeric synthetic resin material so as to exert an elastic clamping action on said projecting end portions of the stiffening wires in said respective grooves.

5. An artificial flower according to claim 4; wherein said assembling element has a substantially centered axial bore opening at least at one end, and further comprising a stamen-and pistil-simulating member having a central plug received in said one end of the axial bore for assembly with said petal-like members.

6. An artificial flower according to claim 5; wherein said axial bore opens at the other end of said assembling element, and further comprising an elongated, stalk-like element having an end portion received in said other end of the axial bore for mounting said petal-like members and said stamen-and pistil-simulating member on said stalk-like element.

7. An artificial flower according to claim 1; wherein said assembling element has a substantially centered axial bore opening at least at one end, and further comprising a stamen-and pistil-simulating member having a central plug received in said one end of the axial bore for assembly with said petal-like members.

8. An artificial flower according to claim 7; wherein said axial bore opens at the other end of said assembling element, and further comprising an elongated stalk-like element having an end portion received in said other end of the axial bore for mounting said petal-like members and said stamen-and pistil-simulating member on said stalk-like element.

9. An artificial flower according to claim 1; wherein said assembling element has a substantially centered axial bore opening at least at one end, and further comprising an elongated, stalk-like element having an end portion received in said one end of the axial bore for mounting said petal-like members on said stalk-like element.

* * * * *